US007352333B2

(12) United States Patent
McCorkle

(10) Patent No.: US 7,352,333 B2
(45) Date of Patent: Apr. 1, 2008

(54) FREQUENCY-NOTCHING ANTENNA

(75) Inventor: John W. McCorkle, Vienna, VA (US)

(73) Assignee: Freescale Semiconductor, Inc., Austin, TX (US)

( * ) Notice: Subject to any disclaimer, the term of this patent is extended or adjusted under 35 U.S.C. 154(b) by 170 days.

(21) Appl. No.: 11/237,751

(22) Filed: Sep. 29, 2005

(65) Prior Publication Data

US 2007/0069955 A1 Mar. 29, 2007

(51) Int. Cl.
*H01Q 13/10* (2006.01)

(52) U.S. Cl. ..... 343/767; 343/700 MS

(58) Field of Classification Search ..... 343/767, 343/700 MS, 769, 829, 830, 846, 848
See application file for complete search history.

(56) References Cited

U.S. PATENT DOCUMENTS 5,748,153 A * 5/1998 McKinzie et al. ..... 343/767
5,828,340 A * 10/1998 Johnson ..... 343/700 MS
6,590,545 B2 * 7/2003 McCorkle ..... 343/830
6,914,573 B1 * 7/2005 McCorkle ..... 343/767
6,980,171 B2 * 12/2005 Maruyama et al. ..... 343/788

* cited by examiner

*Primary Examiner*—Huedung Mancuso

(57) ABSTRACT

An antenna (100) is provided. The antenna includes: a first ground element (105); a first driven element (110) formed from a planar piece of conductive material, the first driven element being configured to transmit and receive wireless signals, the first driven element including a physical slot (130); a conductive line (135) formed in the physical slot such that the conductive line is separated from the first driven element by a gap (G) filled with non-conductive material, the conductive line having a line impedance that is a function of an effective line width of the conductive line, and an effective gap width of a gap between the conductive line and the first driven element; and a signal line (120) configured to send and receive signals to and from the conductive line.

30 Claims, 9 Drawing Sheets

FREQUENCY-NOTCHING ANTENNA

RELATED INVENTIONS

The present invention relates to pending U.S. patent application Ser. No. 11/239,133, entitled "METHOD AND SYSTEM FOR CONTROLLING A NOTCHING MECHANISM," by John W. McCorkle et al., tiled Sep. 30, 2005.

FIELD OF THE INVENTION

The present invention relates in general to the operation of a wireless network, and more particularly to an antenna that creates a frequency notch for transmission and reception of wireless signals. This notch may be fixed or tunable.

BACKGROUND OF THE INVENTION

Wireless systems run into the inherent limitation that there is a finite amount of spectrum available for transmitting signals. And while efforts have been made to split up the spectrum in a time-divided manner to minimize interference, the possibility of interference may remain a concern.

This is a particular problem with systems that occupy a comparatively large frequency range such as wide bandwidth and ultrawide bandwidth (UWB) systems. When a network broadcasts over a large spectrum there may be one or more narrowband interfering signals within that broadcast spectrum. Because of this interference, it may be desirable to limit the extent of transmission or reception over those interfering frequencies. In particular, on the reception side it may be desirable to avoid receiving the energy of interfering signals. While on the transmission side it may be desirable, or even mandated by law, to avoid transmitting signals that will interfere with certain narrowband networks.

By way of example, the current rules set forth by the Federal Communications Commission (FCC) allow for UWB networks to transmit in the spectrum from 3.1 to 10.6 GHz. This spectrum includes other signals (e.g., from cellphone systems, radar, satellite links, altimeters, etc.)

One way to avoid the interfering signals is to include one or more notch filters in the receiver or the transmitter. These filters will reduce a frequency band from the transmitted or received signals, so that the energy transmitted or received over those bands is significantly lowered (depending upon the specific parameters of the notching filters used).

The particular notching frequencies used for a given device may be constant or variable. For example, if there are known interfering signals that are likely to always be present, or for which transmission interference must always be avoided, a notching device may be pre-programmed to provide a frequency notch at that known notch frequency. However, if the precise frequencies of interfering signals are unknown or intermittent in nature, it may be desirable to provide a notch filter that can have its filtering parameters dynamically changed to meet varying needs.

However, in an electronic device, every bit of space is precious. The inclusion of one or more notching elements will generally increase the size and cost of a device by requiring additional circuitry and using up valuable space on an integrated circuit (IC). It would therefore be desirable to provide a notching element that minimized the amount of additional circuitry required and did not take up significant space in an IC.

BRIEF DESCRIPTION OF THE DRAWINGS

The accompanying figures where like reference numerals refer to identical or functionally similar elements and which together with the detailed description below are incorporated in and form part of the specification, serve to further illustrate an exemplary embodiment and to explain various principles and advantages in accordance with the present invention.

DETAILED DESCRIPTION

The instant disclosure is provided to further explain in an enabling fashion the best modes of performing one or more embodiments of the present invention. The disclosure is further offered to enhance an understanding and appreciation for the inventive principles and advantages thereof, rather than to limit in any manner the invention. The invention is defined solely by the appended claims including any amendments made during the pendency of this application and all equivalents of those claims as issued.

It is further understood that the use of relational terms such as first and second, and the like, if any, are used solely to distinguish one from another entity, item, or action without necessarily requiring or implying any actual such relationship or order between such entities, items or actions. It is noted that some embodiments may include a plurality of processes or steps, which can be performed in any order, unless expressly and necessarily limited to a particular order; i.e., processes or steps that are not so limited may be performed in any order.

Frequency-Notching Antenna

Figure 1:
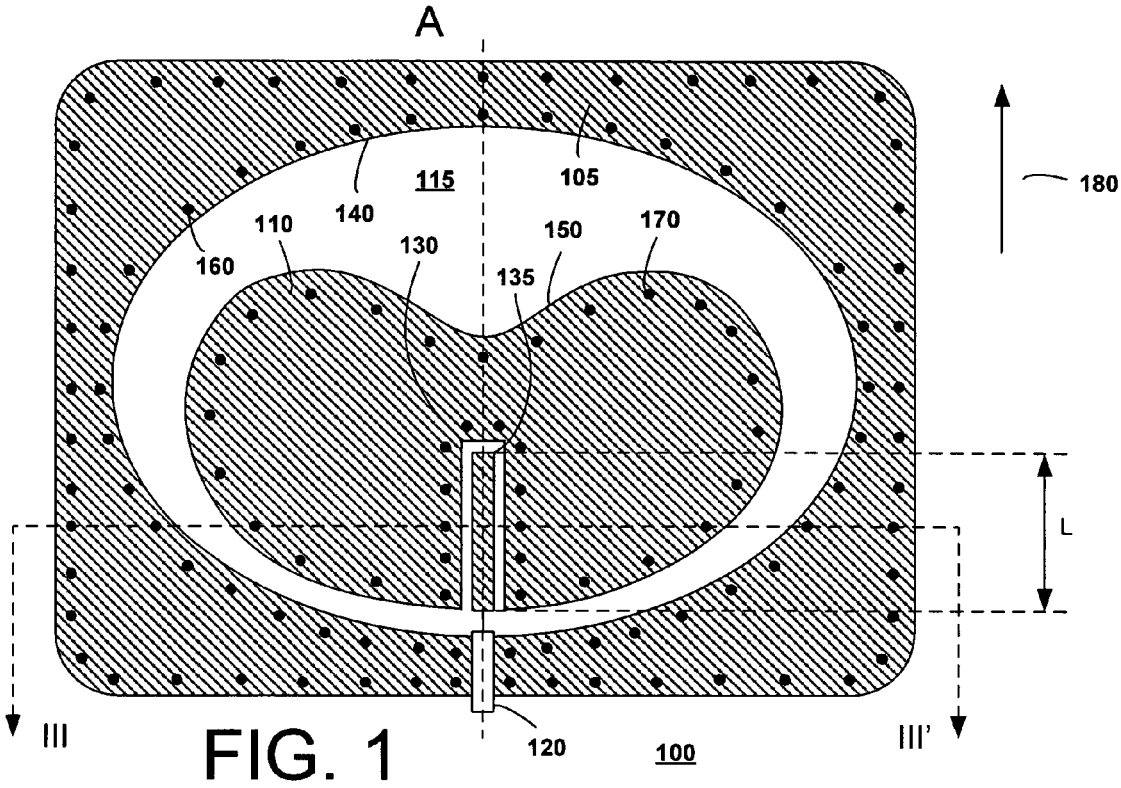
FIG. 1 is an overhead diagram of a first layer of a frequency-notching antenna according to a disclosed embodiment of the present invention.

FIG. 1 is an overhead diagram of a first layer of a frequency-notching antenna according to a disclosed embodiment of the present invention. As shown in FIG. 1, the first antenna layer 100 has a first ground element (i.e., a ground plane) 105, a first driven element 110, a first tapered clearance area 115 between the first ground element 105 and the first driven element 110, and an antenna input 120. The first driven element 110 includes a slot 130 with a conductive line 135 placed within the slot 130 and electrically connected to the antenna input 120.

The ground element 105 may include a plurality of ground element connection vias 160 to be used as first conductive connection elements if the antenna of which the first antenna layer 100 is a part is a multilevel antenna. These ground element connection vias 160 will connect the ground element 105 to other ground elements on other levels. Similarly, the first driven element 110 may include a plurality of driven element connection vias 170 to be used as second conductive connection elements if the antenna of which the first antenna layer 100 is a part is a multilevel antenna. These driven element connection vias 170 will connect the first driven element 110 to other driven elements on other levels.

The first ground element 105 in the embodiment of FIG. 1 is a planar layer with an oval or elliptical section cut out of it that has a first inner circumference 140. In this embodiment, the first ground element 105 is cut to occupy only a thin perimeter around the cutout section so that the first antenna layer 100 is electrically small. However, in alternate embodiments the first ground element 105 can be increased in size. The first ground element 105 is connected to a ground potential.

The first driven element 110 in this embodiment has a first outer circumference 150 in an oval shape with a depression formed in it, making it shaped generally like a kidney bean (i.e., it is reniform in shape). The first driven element 110 is smaller in size than the cutout section of the first ground element 105, so that it will fit within the cut out section of the ground element.

The first driven element 110 and the first ground element 105 can be formed from any conductive material (e.g., copper, aluminum, etc.). They can be formed on a common plane (or conformal surface) or can be slightly offset, such as the top and bottom of a printed circuit (PC) board.

The first driven element 110 is placed inside the cutout section of the first ground element 105 to form the first tapered clearance area 115. The first tapered clearance area 115 is symmetrically tapered about the axis A, which passes through the antenna input 120. Both the first driven element 110 and the cutout section of the first ground element 105 have an axis of symmetry about the axis A. The first tapered clearance area 115 is tapered such that it has a minimum width at the antenna input 120 and a maximum width at a point opposite the antenna input 120. The first tapered clearance area 115 is non-conductive. In some embodiments the clearance area 115 can be filled with Teflon, epoxy-fiberglass, or alumina.

In alternate embodiments, however, the shape of the cutout section and the first driven element 110 can be designed in accordance with the desired application. As a result, the ultimate shape of the first tapered clearance area 115 can take many forms, of which a few are discussed below. To maintain maximum bandwidth, the first clearance area 115 should be limited such that it does not ever reduce in width as it passes from the antenna input 120 to the point opposite the input 120. However, in alternate embodiments width reductions can be used to achieve band-stop performance when desired.

The antenna input 120 in this embodiment is located across the narrowest gap between the first ground element 105 and the first driven element 110. In other words, the antenna input 120 is located where the first clearance area 115 has a minimum width. The antenna input can be a metal layer formed on a PC board, a magnet wire, a coaxial cable, a line laid over the ground plane, a twin-lead line, a twisted pair line, or any other desired transmission medium.

The slot 130 in this embodiment is formed in the first driven element 110 opposite the antenna input 120. In the embodiment of FIG. 1, the slot is rectangular, opening into the first clearance area 115, and extending into the first driven element 110. The slot 130 is filled with a non-conductive slot dielectric. This slot dielectric may be the same or a different material as what is formed in the first clearance area 115.

The conductive line 135 is placed in the slot 130 such that there is a gap of the non-conductive slot dielectric between the conductive line 135 and the first driven element 110. In the embodiment of FIG. 1, this gap is constant along the circumference of the conductive line 135 facing the first driven element 110. However, in alternate embodiments the gap may vary in width. The conductive line 135 drives the first driven element 110 of the first antenna layer 100 as an open-circuit conductive line, based on a driving signal received from the antenna input 120. The conductive line 135 is formed from a conductive material (e.g., copper, aluminum, etc.). It can be formed on a common plane (or conformal surface) with the driven element 110, or can be slightly offset, such as the top and bottom of a printed circuit (PC) board.

The ground element connection vias 160 and the driven element connection vias 170, if they are included, are made of a conductive material (e.g., copper, aluminum, etc.). In the embodiment disclosed in FIG. 1, they particularly comprise a conductive material filling holes made in the first ground element 105 and first driven element 110, respectively.

In the embodiment shown in FIG. 1, the antenna input 120 is connected to the conductive line 135 by a set of linear connectors. However, alternate connections are possible. For example, the connection could be a curved metal layer, a solder connection, etc.

Figure 2:
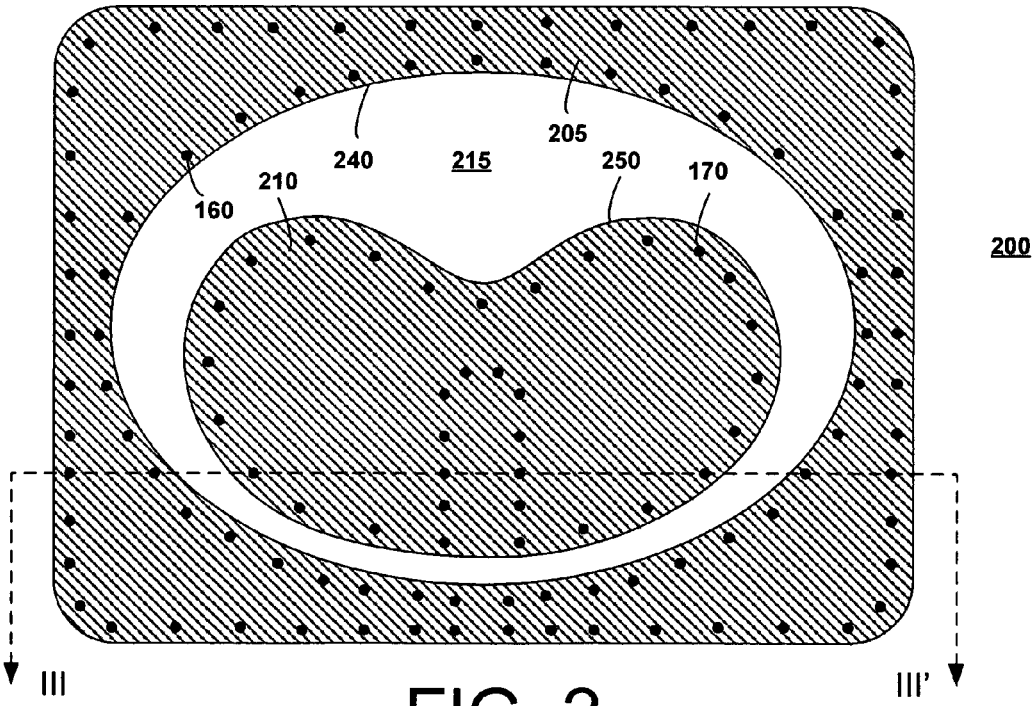
FIG. 2 is an overhead diagram of a second layer of a multiple-layer frequency-notching antenna including a frequency notch according to a disclosed embodiment of the present invention.

The first antenna layer 100 may operate on its own as an antenna, or it may be a part of a multiple-layer antenna. FIG. 2 is an overhead diagram of a second layer of a multiple-layer frequency-notching antenna including a frequency notch according to a disclosed embodiment of the present invention.

As shown in FIG. 2, the second antenna layer 200 has a second ground element (i.e., a ground plane) 205, a second driven element 210, and a second tapered clearance area 215 between the second ground element 205 and the second driven element 210. The second ground element 205 may include the plurality of ground element connection vias 160 that connect the second ground element 205 to other ground elements on other levels. Similarly, the second driven element 210 may include the plurality of driven element connection vias 170 that connect the second driven element 210 to other driven elements on other levels.

The second ground element 205 is of the same size, shape, and material as the first ground element 105, and is likewise connected to a ground potential. The second driven element 210 is of the same size, shape, and material as the first driven element 110, except that the second driven element does not have a slot cut into it. As a result of this, the second ground element 105 has a second inner circumference 240 that is the same as the first inner circumference 140, and the second driven element 110 has a second outer circumference 250 that is the same as the first outer circumference 150. The second inner and outer circumferences define a second clearance area 215 that is the same size and shape as the first clearance area 115.

Figure 3:
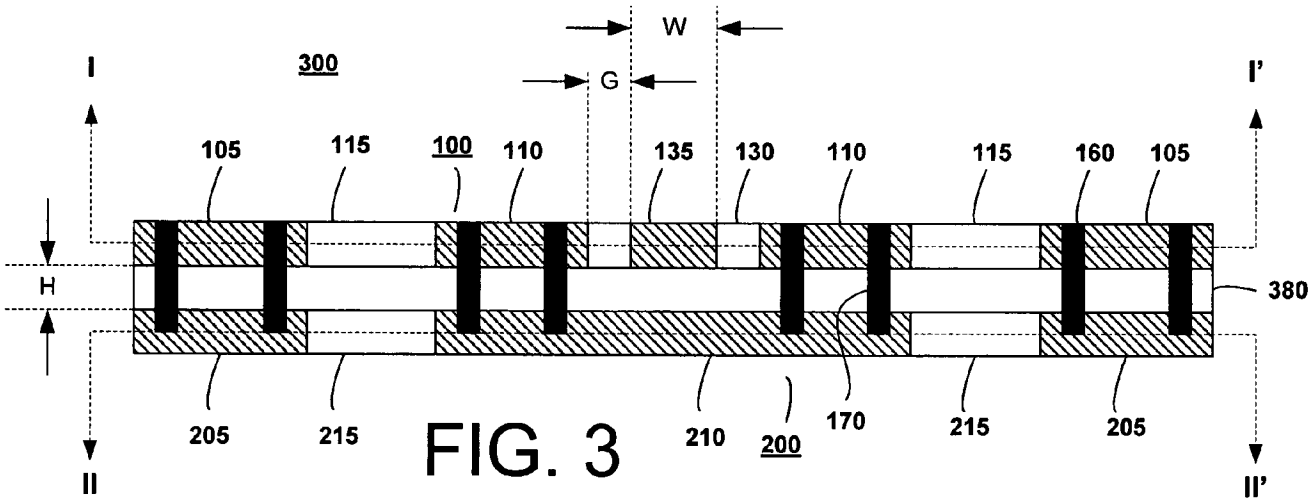
FIG. 3 is cut-away view of a two-active-layer frequency-notching antenna, according to a disclosed embodiment of the present invention.

FIG. 3 is cut-away view of a two-active-layer frequency-notching antenna, according to a disclosed embodiment of the present invention. As shown in FIG. 3, in this embodiment, the first antenna layer 100 is placed over top the second antenna layer 200 such that the first and second ground elements 105 and 205 are aligned with each other, and the first and second driven elements 110 and 210 are aligned with each other. The two antenna layers 100 and 200 are separated by a first insulating layer 380, that may be formed of an insulating material. In some embodiments the first insulating layer 380 can comprise Teflon, epoxy-fiberglass, or alumina.

In the embodiment of FIG. 3, the first and second ground elements 105 and 205 are connected by the plurality of ground element connection vias 160. These ground element connection vias 160 are located around the outer edge of the first and second ground elements 105 and 205, and around the first and second inner circumferences 140 and 240. They serve to electrically connect these two elements 105 and 205. These could be removed in alternate embodiments.

Similarly, in the embodiment of FIG. 3, the first and second driven elements 110 and 210 are connected by the plurality of driven element connection vias 170. These driven element connection vias 170 are located around the outer circumferences 150 and 250, around the edges of the slot 130 in the first antenna layer 100, and at points opposite the edges of the slot 130 in the second antenna layer 200. They serve to electrically connect these two elements 105 and 205. These could be removed in alternate embodiments.

The plurality of ground element connection vias 160 and the plurality of driven element connection vias 170 are passages through one or more layers that are filled with a conductive material. They can be eliminated in whole or in part in any embodiment that has a single layer or that has multiple layers that do not require their connections.

In some embodiments the second antenna layer 200 shown in FIG. 2 could be used as a single-layer antenna, without the first antenna layer 100. In this case an antenna input 120 would be provided to the second antenna layer 200, and would drive an open circuited transmission line that runs parallel to the second driven element 210. The open-circuited transmission line could be a coaxial cable, a properly insulated and spaced magnet wire, multiple magnet wires spaced to give a desired low impedance, multiple coaxial cables connected in parallel to give the desired low impedance, or any other suitable elements that could be used to create an open-circuit transmission line. This embodiment could use all the variations in structure described below.

Figure 4:
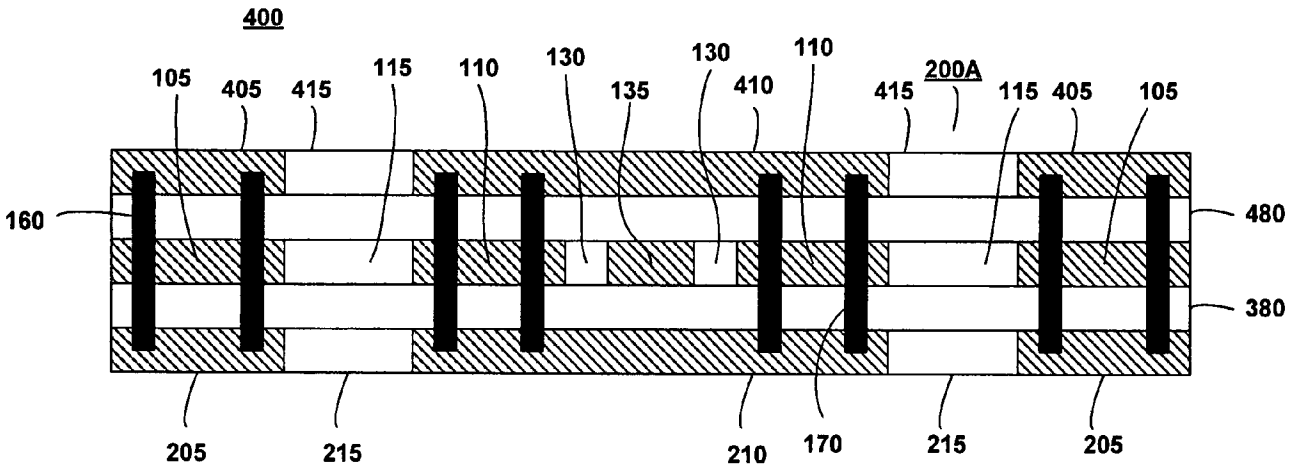
FIG. 4 is cut-away view of a three-active-layer frequency-notching antenna, according to one disclosed embodiment of the present invention.

FIG. 4 is cut-away view of a three-active-layer frequency-notching antenna, according to a one disclosed embodiment of the present invention. This embodiment is similar to the two-active-layer antenna of FIG. 2, except that it has a third antenna layer 200A, similar to the second antenna layer 200, formed on an opposite side of the first antenna layer 100 from the second antenna layer 200, and separated from the first antenna layer by a second insulating layer 480.

As shown in FIG. 4, the first and second antenna layers 100 and 200 are connected as shown in the embodiment of FIG. 3. In addition, a third antenna layer 200A is provided. The third antenna layer 200A includes a third ground element (i.e., a ground plane) 405, a third driven element 410, and a third tapered clearance area 415 between the third ground element 405 and the third driven element 410. The third ground element 405 is connected to the ground potential and includes the plurality of ground element connection vias 160, which connect the third ground element 405 to the first and second ground elements 105 and 205. Similarly, the third driven element 410 includes the plurality of driven element connection vias 170, which connect the third driven element 410 to the first and second driven elements 110 and 210.

In the embodiment of FIG. 4, the ground element connection vias 160 extend to connect all of the first, second, and third ground elements 105, 205, and 405 together, while the driven element connection vias 170 extend to connect all of the first, second, and third driven elements 110, 210, and 410 together. In alternate embodiments the same vias 160 and 170 need not connect to all layers. Separate vias could be used to connect any or all of the elements on the three layers as needed, or the vias 160 and 170 could be eliminated altogether. Furthermore, vias connecting the first antenna layer 100 to the second antenna layer 200 need not be in the same relative position as vias connecting the first antenna layer 100 to the third antenna layer 200A.

Figure 5:
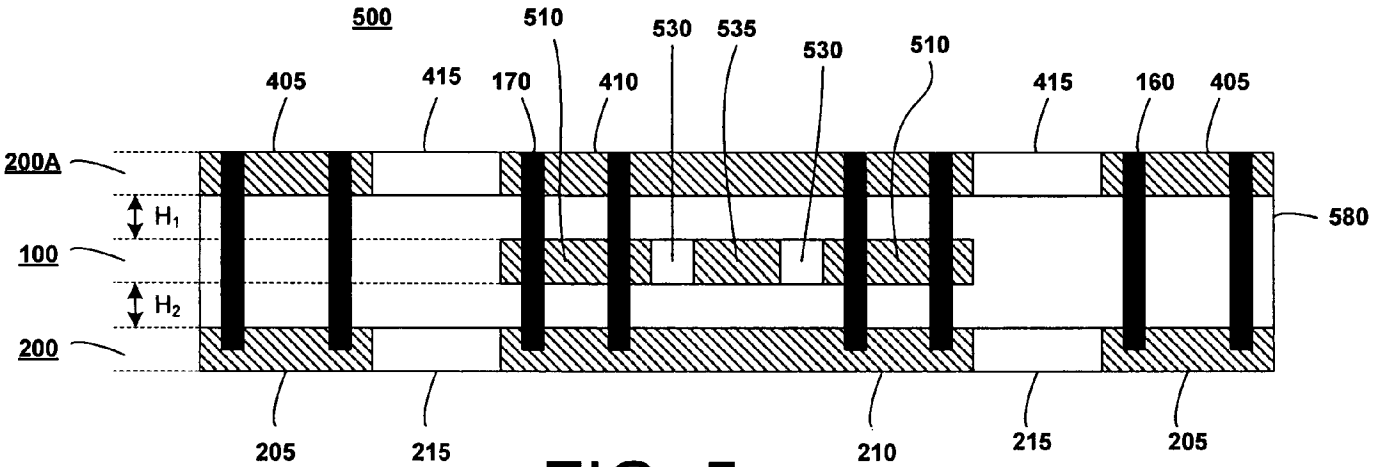
FIG. 5 is cut-away view of a three-active-layer frequency-notching antenna, according to another disclosed embodiment of the present invention.

FIG. 5 is cut-away view of a three-active-layer frequency-notching antenna, according to another disclosed embodiment of the present invention. The embodiment of FIG. 5 is similar to the embodiment of FIG. 4, except that the first ground element 105 in the first antenna layer 100 is eliminated.

In the embodiment of FIG. 5, the first, second, and third antenna layers 100, 200, and 200A are separated from each other by a third insulating layer 580. This third insulating layer 580 may be a contiguous layer containing the first antenna layer 100 and separating it from the second and third antenna layers 200 and 200A, or it could be made up of multiple individual layers.

The ground element connection vias 160 in the embodiment of FIG. 5 are used to connect the second ground layer 205 with the third ground layer 405 through the third insulating layer 580. They can be eliminated in alternate embodiments.

Figure 6:
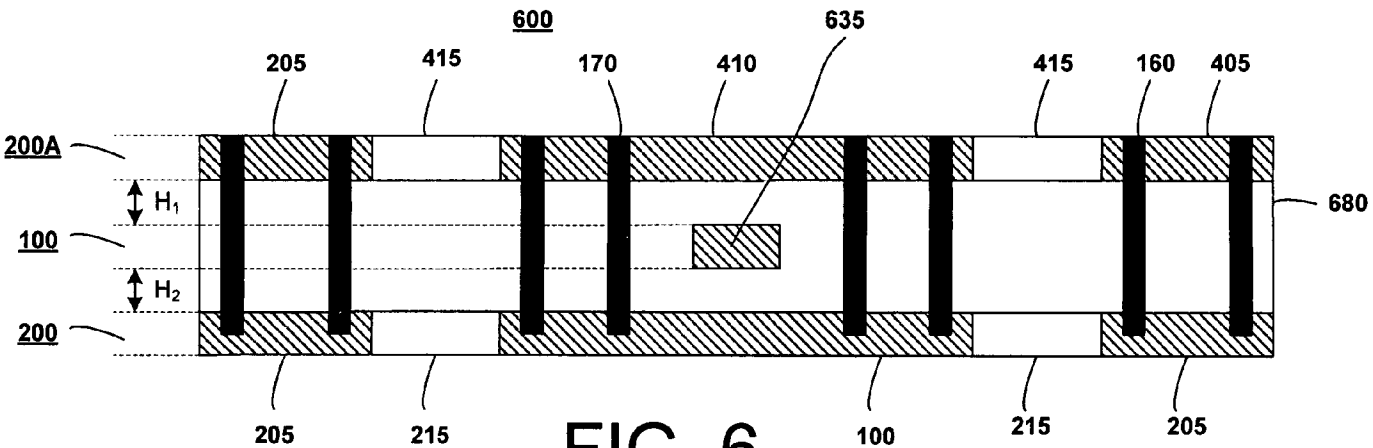
FIG. 6 is cut-away view of a three-active-layer frequency-notching antenna, according to yet another disclosed embodiment of the present invention.

FIG. 6 is cut-away view of a three-active-layer frequency-notching antenna, according to yet another disclosed embodiment of the present invention. The embodiment of FIG. 6 is similar to the embodiment of FIG. 4, except that the first ground element 105 and the first driven element 110 in the first antenna layer 100 are eliminated. In this case the first antenna layer 100 includes just the conductive line 135 placed in an appropriate location with respect to the second and third driven elements 210 and 410.

In the embodiment of FIG. 6, the first, second, and third antenna layers 100, 200, and 200A are separated from each other by a fourth insulating layer 680. This fourth insulating layer 680 may be a contiguous layer containing the first antenna layer 100 and separating it from the second and third antenna layers 200 and 200A, or it could be made up of multiple individual layers.

The ground element connection vias 160 in the embodiment of FIG. 6 are used to connect the second ground layer 205 with the third ground layer 405 through the fourth insulating layer 680. Similarly, the driven element connection vias 170 in the embodiment of FIG. 6 are used to connect the second driven layer 210 with the third driven layer 410 through the fourth insulating layer 680. These connection vias 160 and 170 can be eliminated in whole or in part in alternate embodiments.

Although the conductive line 135 in FIG. 1 is shown as being rectangular, it need not be limited to such a shape. In alternate embodiments the conductive line 135 can be a variety of shapes, including a curved line, a line in multiple sections where each section is wider or narrower than its neighbors, or a line with slots cut into it. Likewise, although the slot 130 is shown as having a generally rectangular shape, it can be a variety of shapes (e.g., curved), or may have additional slots formed in its perimeter. For example, the slot 130 could be cruciform in shape, having a long lengthwise passage from the first clearance area 115 into the first driven element 110, with two smaller slots extending from the sides of the lengthwise passage and perpendicular to the lengthwise passage. The conductive line 135 formed in this cruciform slot could also vary in shape, e.g., being rectangular or cruciform.

Figure 7:
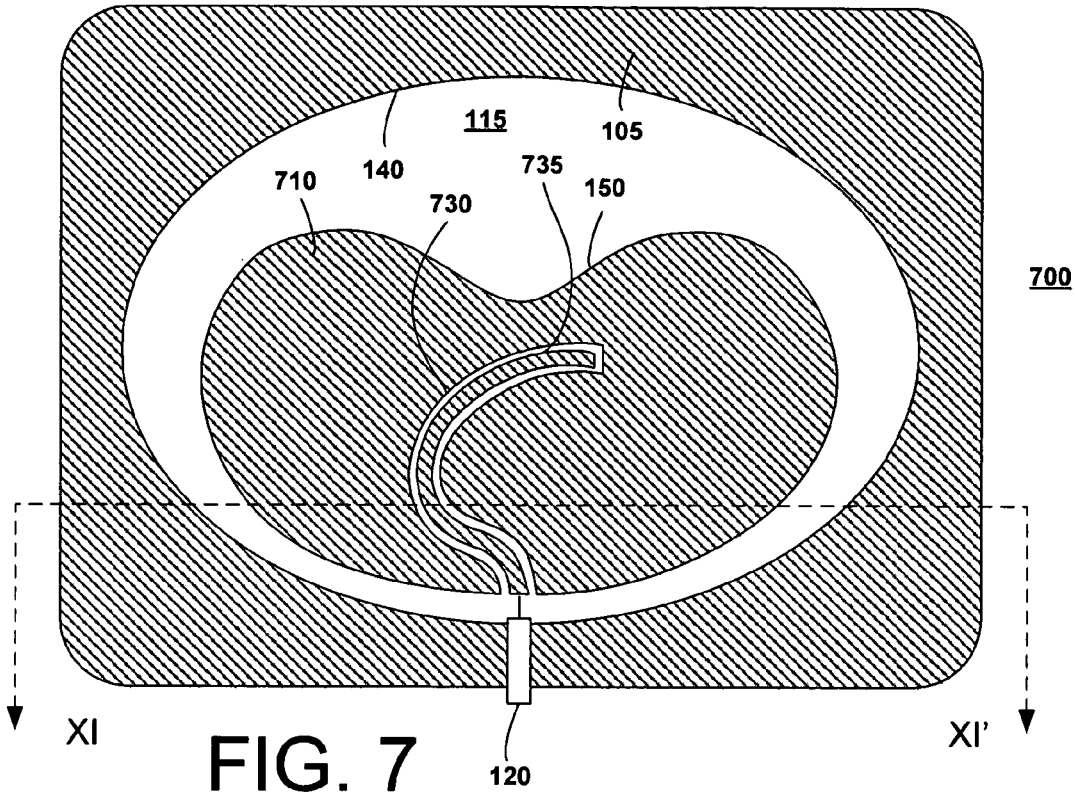
FIG. 7 is an overhead diagram of a first layer of a frequency-notching antenna according to another disclosed embodiment of the present invention.
Figure 8:
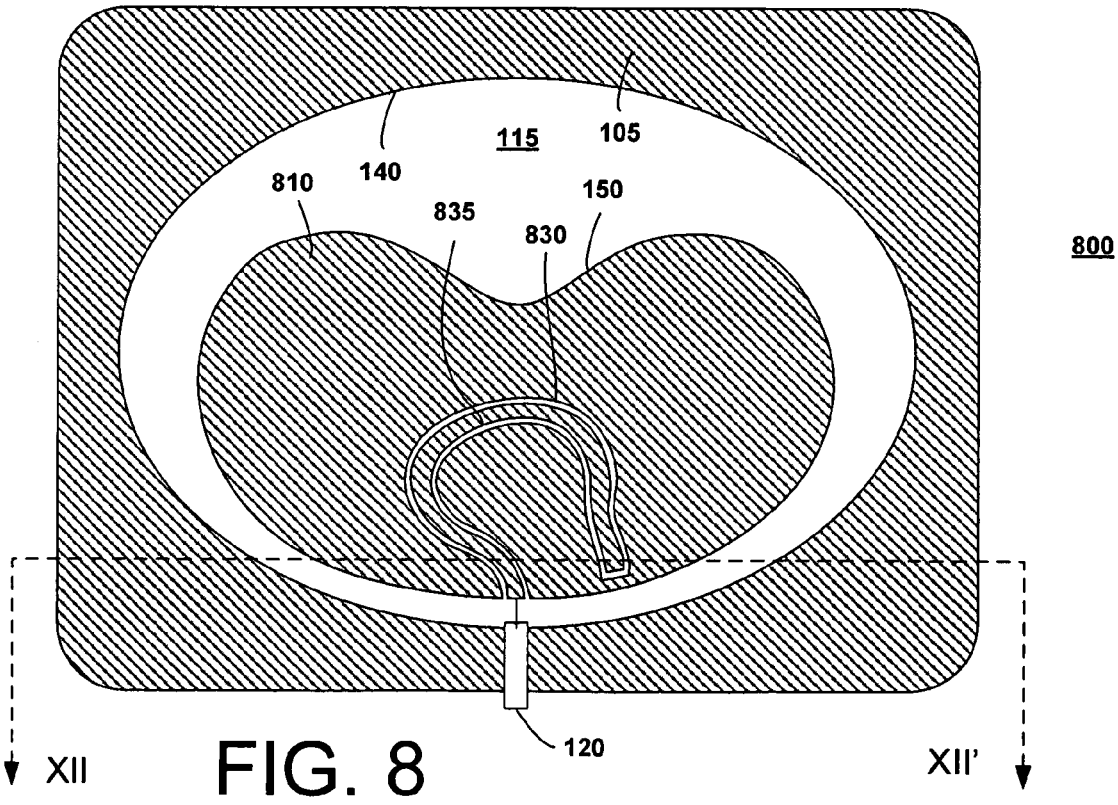
FIG. 8 is an overhead diagram of a first layer of a frequency-notching antenna according to yet another disclosed embodiment of the present invention.

FIG. 7 is an overhead diagram of a first layer of a frequency-notching antenna according to another disclosed embodiment of the present invention, and FIG. 8 is an overhead diagram of a first layer of a frequency-notching antenna according to yet another disclosed embodiment of the present invention. The embodiments of FIGS. 7 and 8, show curved conductive lines in curved slots.

As shown in FIG. 7, the first antenna layer 700 has a first ground element (i.e., a ground plane) 105, a first driven element 710, a first tapered clearance area 115 between the first ground element 105 and the first driven element 710, and an antenna input 120. The first driven element 110 includes a slot 730 with a conductive line 735 placed within the slot 730 and electrically connected to the antenna input 120. An antenna using the first antenna layer 700 of FIG. 7 can be used exactly as an antenna using the first antenna layer 100 of FIG. 1, and would operate in a similar manner.

As shown in FIG. 8, the first antenna layer 800 has a first ground element (i.e., a ground plane) 105, a first driven element 810, a first tapered clearance area 115 between the first ground element 105 and the first driven element 810, and an antenna input 120. The first driven element 110 includes a slot 830 with a conductive line 835 placed within the slot 830 and electrically connected to the antenna input 120. An antenna using the first antenna layer 800 of FIG. 8 can be used exactly as an antenna using the first antenna layer 100 of FIG. 1, and would operate in a similar manner.

The embodiments of FIGS. 7 and 8 differ from that of FIG. 1 in that the slots 730 and 830 in the first driven elements 710 and 810, respectively, and the conductive lines 735 and 835 are not rectangular in shape. As shown in FIG. 7, the slot 730 and conductive line 735 are curved. And as shown in FIG. 8, the slot 830 and conductive line 835 are curved so much as to approach the outer circumference 150 of the driven element 810. By making the conductive line 735 or 835 curved, the electrical length of the conductive line 735 or 835 can be extended, allowing the conductive lines to have a greater physical length than would be possible if the conductive line had to be straight.

Although FIGS. 7 and 8 show no connecting vias 160 and 170, this is by way of example only. Any embodiment that includes multiple antenna layers may have the ground elements of those layers connected by ground element connecting vias 160, and may have the driven elements of those layers connected by driven element connecting vias 170, as described above with respect to FIGS. 1 to 6.

Frequency Notching

The combination of the slot 130 and the conductive line 135 creates a notch filter in any antenna using the first antenna layer (whether it be a one-active-layer antenna, a two-active-layer antenna, a three-active-layer antenna, etc.) The notching parameters of this notch filter depend upon the characteristic impedance $Z_0$ of the conductive line 135, and the electrical length of the conductive line 135, and both the characteristic impedance $Z_0$ and the electrical length of the conductive line 135 depend on the physical parameters of the antenna. In particular, the characteristic impedance $Z_0$ of the conductive line 135 will determine the width of the resulting notch, and the electrical length of the open circuit formed by the conductive line 135 will determine the frequency of the resulting notch.

In the embodiment of FIGS. 1 to 8, the physical parameters that determine the characteristic impedance $Z_0$ of the conductive line 135 include the line width (W) of the conductive line 135, the gap width (G) between the conductive line 135 and the first driven element 110, and the dielectric constant of the insulating material that fills the portion of the slot 130 unoccupied by the conductive line 135. In the embodiment of FIG. 3, these physical parameters also include the height (H) between the conductive line 135 and the second driven element 210 (i.e., the height of the first insulating layer 380), and the dielectric constant of the first insulating layer 380. In the embodiments of FIGS. 4 to 6, these physical parameters also include the first height ($H_1$) between the conductive line 135 and the second driven element 210 (i.e., the height of the first insulating layer 380), the second height ($H_2$) between the conductive line 135 and the third driven element 410 (i.e., the height of the second insulating layer 480), and the dielectric constants of the first and second insulating layers 380 and 480.

A typical antenna input 120 may have an input impedance $Z_I$ of 50 ohms, while a conductive line 135 might have a characteristic impedance $Z_0$ of 5 or 10 ohms. The conductive line will generally have a characteristic impedance $Z_0$ that is lower than the input impedance $Z_I$ of the antenna input 120.

In the embodiment of FIGS. 1 to 8, the physical parameters that determine the electrical length of the conductive line 135 include the physical length (L) of the conductive line 135 and the dielectric constant of the insulating material that fills the portion of the slot 130 unoccupied by the conductive line 135.

Although in FIGS. 1 to 8, the parameters for W, G, H, $H_1$, and $H_2$ are shown as being constant values, alternate embodiments may use antenna designs for which these parameters vary. For example, a slot 130 and conductive line 135 may be provided such that the width (W) of the conductive line 135 varies over the length of the conductive line 135, and the gap (G) between the conductive line 135 and the driven element varies over the length of the gap.

Figure 9:
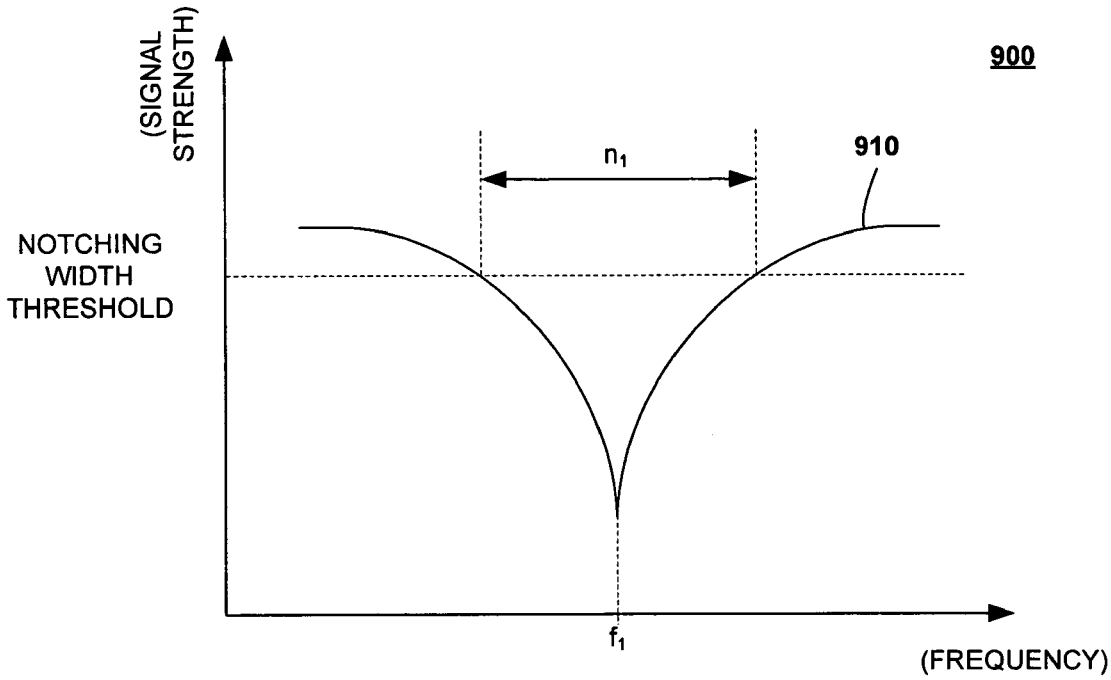
FIGS. 9 and 10 are graphs of a signal notches according to disclosed embodiments of the present invention.
Figure 10:
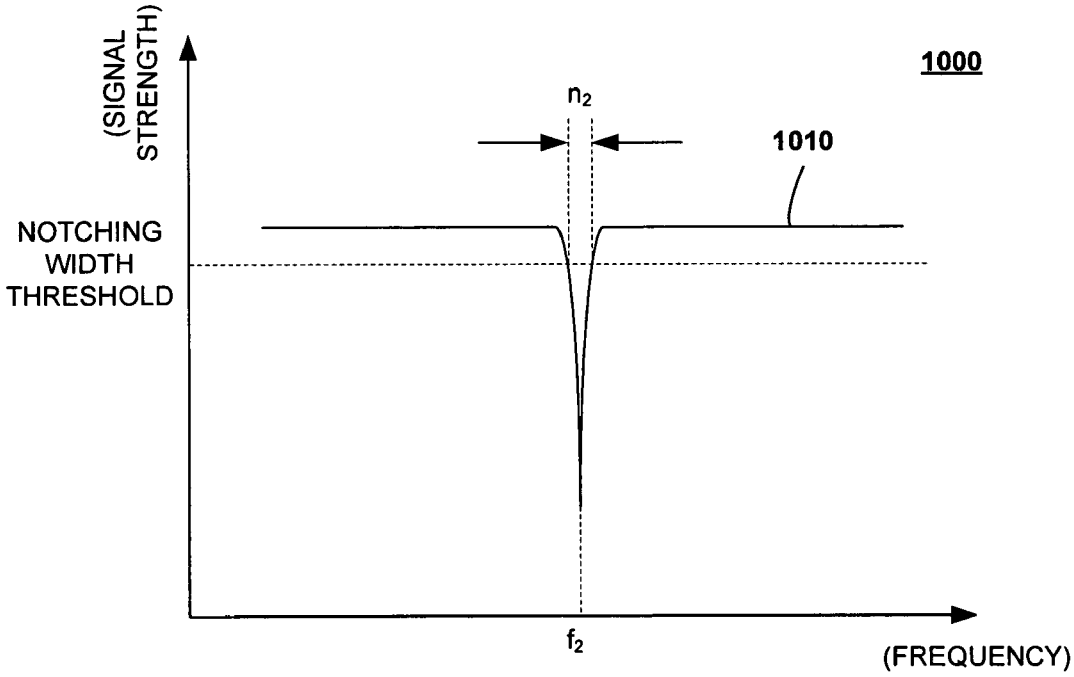

FIGS. 9 and 10 are graphs of a signal notches according to disclosed embodiments of the present invention. In particular, FIG. 9 shows a first frequency notch 910 having a first notch width $n_1$, and a first notch frequency $f_1$, while FIG. 10 shows a second frequency notch having a second notch width $n_2$ and a second notch frequency $f_2$.

In FIGS. 9 and 10, the first and second notch widths $n_1$ and $n_2$ are determined by looking at where the signal power falls below a set notching width threshold (typically −3 dB or −6 dB). Since in FIGS. 9 and 10 ($n_1$>$n_2$), FIG. 9 shows a notch filter with a comparatively high value of $Z_0$, and FIG. 10 shows a notch filter with a comparatively low value for $Z_0$.

Tunable Frequency-Notching Antenna

As noted above, the notching frequency of the notch filters shown in FIGS. 1 to 8 is dependent upon the electrical length of the open circuit formed by the conductive line 135. Thus, anything that will change the electrical length of this open circuit will change its notching frequency, rendering the notch tunable.

One way to change the electrical length of the open circuit formed by the conductive line 135 is to use a changeable dielectric material for the insulating material that fills the portion of the slot 130 unoccupied by the conductive line 135. Such a changeable dielectric material can have its dielectric constant changed by impressing a static field across it. By changing the dielectric constant of the insulating material that fills the portion of the slot 130 unoccupied by the conductive line 135, the device can dynamically change the electrical length of the conductive line 135, allowing the device to tune the frequency of the notch it creates.

Figure 11:
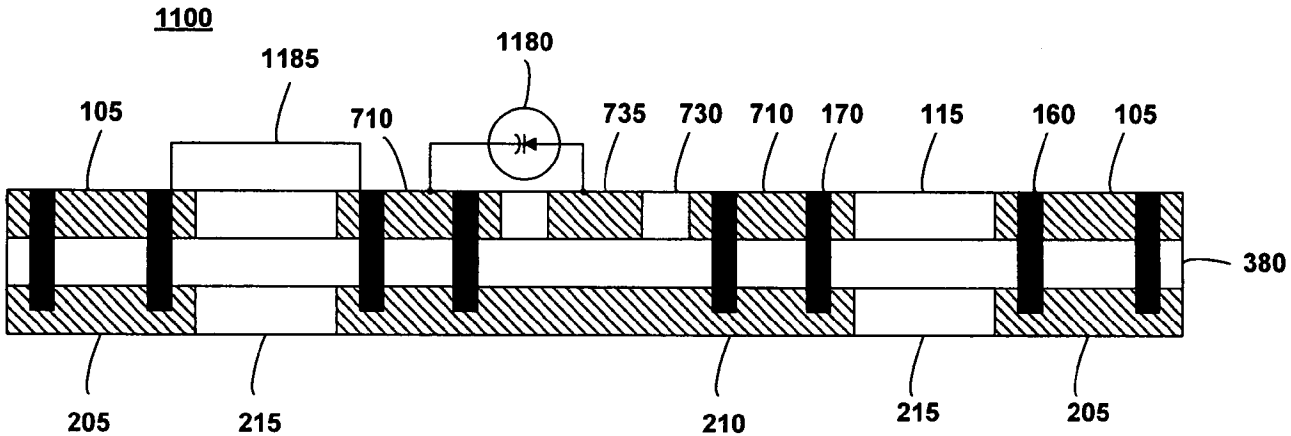
FIG. 11 is cut-away view of a two-active-layer tunable frequency-notching antenna, according to another disclosed embodiment of the present invention.

Another way to create a tunable notch is to connect the connecting line 135 to the first driven element 110 via varactor. FIG. 11 is cut-away view of a two-active-layer tunable frequency-notching antenna, according to another disclosed embodiment of the present invention. As shown in FIG. 11, the antenna 1100 includes a first antenna layer 700 of FIG. 7 over a second antenna layer 200 of FIG. 2. In addition, one or more varactors 1180 (e.g., one or more varactor diodes) are provided between the first driven element 710 and the conductive line 735 of the first antenna layer 700. An inductive/resistive network 1185 is also provided, connecting the first driven element 710 to the first ground element 105 in order to impress a static DC back-bias voltage across the one or more varactors 1180. The DC back-bias voltage passed from the antenna input 120, across the one or more varactors 1180, and to the first ground element 105. Alternatively, the inductive/resistive network 1185 could connect directly to the controller circuitry.

As the capacitance of the one or more varactors 1180 changes, so too does the electrical length of the conductive line 735, thus changing the frequency of the notch created by the conductive line 735. In this way the frequency of the notch created by the antenna 1100 can be tuned through the control signal of the one or more varactors 1180.

The inductive/resistive network 1185 connecting the first driven element 710 to the first ground element 105 can be a resistor, an inductor, or a resistor and an inductor in series. The inductance of the inductive/resistive network 1185 can be set to be very high as compared to the input inductance of the signal line 120, e.g., by a factor of ten, rendering it effectively an open circuit for radio frequency (RF) signals, but a short circuit for purposes of controlling the one or more varactors 1180. For example, if the input impedance $Z_I$ of the signal line 120 were 50 ohms, the network impedance $Z_N$ of the inductive/resistive network 1185 could be 500 ohms.

In the embodiment of FIG. 11, one varactor 1180 is connected to the conductive line 735 at an end farthest from the signal line 120. However, this is by way of example only. In alternate embodiments one or more varactors 1180 could be connected to any portion of the conductive line 735. It could also represent a plurality of varactors located at various positions down the conductive line 135 (e.g., equally spaced down the length of the conductive line 135).

Although the embodiment of FIG. 11 is shown with respect to a curved conductive line 735, this is by way of example only. A varactor 1180 can be connected between a driven element and a conductive line of any appropriate shape. In addition, in the embodiment of FIG. 11, the varactor 1180 is shown as being connected between a conductive line and a driven element on the same antenna level. In alternate embodiments, however, a varactor can be connected between a conductive line and a driven element on any antenna level. Also, the number of layers and their connections using connecting vias 160 and 170 can be implemented in a variety of ways, as described above with respect to FIGS. 1 to 8.

Figure 12:
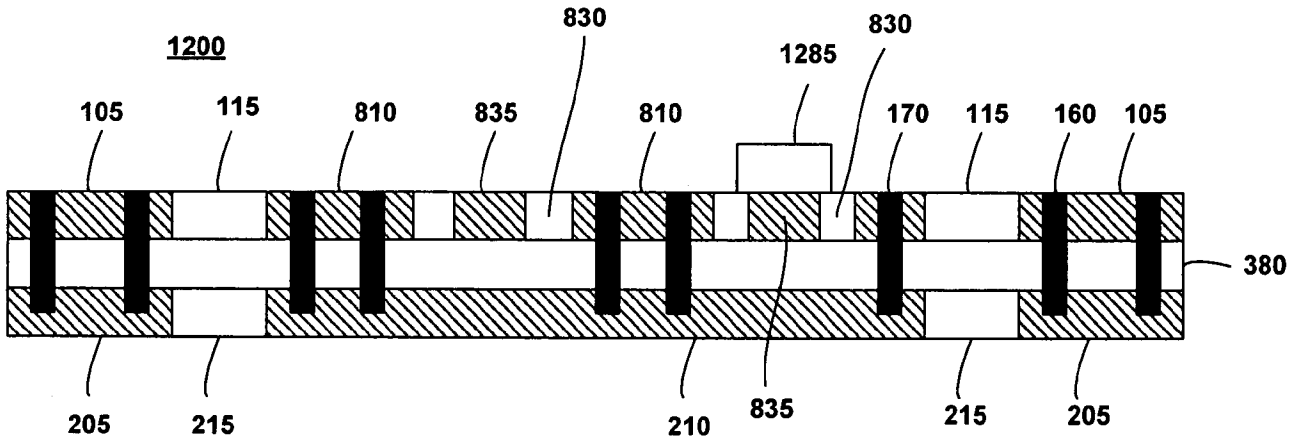
FIG. 12 is cut-away view of a two-active-layer tunable frequency-notching antenna, according to yet another disclosed embodiment of the present invention.

The electrical length of the conductive line can also be changed using a circuit more complicated than just a simple varactor. FIG. 12 is cut-away view of a two-active-layer tunable frequency-notching antenna, according to yet another disclosed embodiment of the present invention. As shown in FIG. 12, the antenna 1200 includes a first antenna layer 800 of FIG. 8 over a second antenna layer 200 of FIG. 2. In addition, an electrical length adjustment circuit 1285 is provided between the first driven element 810 and the conductive line 835 of the first antenna layer 800. The electrical length adjustment circuit 1285 may also connect to the ground element 105 of the first antenna layer 800 and a controller 1350.

Figure 13:
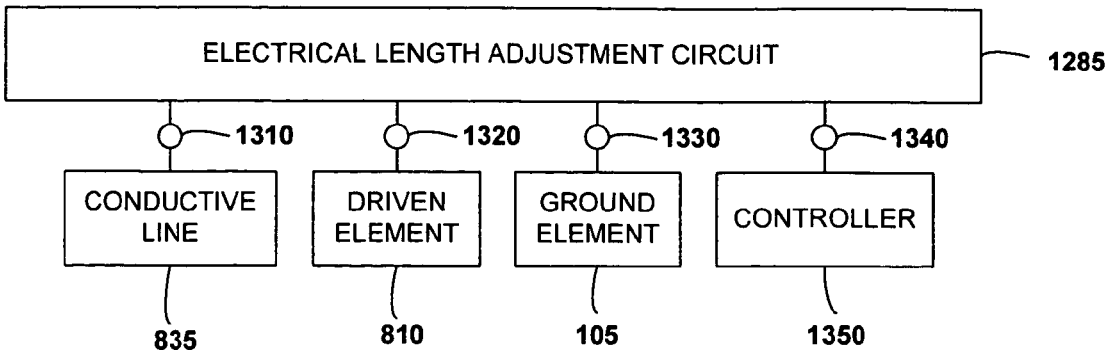
FIG. 13 is a block diagram of circuitry for controlling the electrical length of a conductive line according to a disclosed embodiment of the present invention.

FIG. 13 is a block diagram of circuitry for controlling the electrical length of a conductive line according to a disclosed embodiment of the present invention. As shown in FIG. 13, the electrical length adjustment circuit 1285 of FIG. 13 includes a first node 1310 connected to the conductive line 835, a second node connected to the first driven element 835, a third node 1330 connected to the first ground element 105, and a fourth node 1340 connected to a controller. In alternate embodiments the third or fourth nodes 1330 and 1340 may be removed.

The controller 1350 is an element external to the antenna 1200 that provides control signals to the electrical length adjustment circuit 1285 that can help adjust the electrical length of the conductive line 835. It can be any sort of controller desired, e.g., a microprocessor controller.

The embodiment of FIGS. 12 and 13 is shown using a first antenna layer 800 in which the conductive line 835 curves such that one end of the conductive line 835 is very close to the first ground element 105, and the electrical length adjustment circuit 1285 is connected to the conductive line 835 at an end farthest from the antenna input 120. This allows for a more economical connection between the conductive line 835 and the first ground element 105. However, this is by way of example only. In alternate embodiments the conductive line 835 could be arranged in any desired pattern, and the electrical length adjustment circuit 1285 could be connected to any portion of the conductive line 835, to render a different tuning function with respect to the control signal.

Although the embodiment of FIGS. 12 and 13 is shown with respect to a curved conductive line 835, this is by way of example only. An electrical length adjustment circuit 1285 can be connected between a driven element and a conductive line of any appropriate shape. In addition, in the embodiment of FIGS. 12 and 13, the electrical length adjustment circuit 1285 is shown as being connected between a conductive line and a driven element on the same antenna level. In alternate embodiments, however, an electrical length adjustment circuit can be connected between a conductive line and a driven element on any antenna level. Also, the number of layers and their connections using connecting vias 160 and 170 can be implemented in a variety of ways, as described above with respect to FIGS. 1 to 8.

Figure 14:
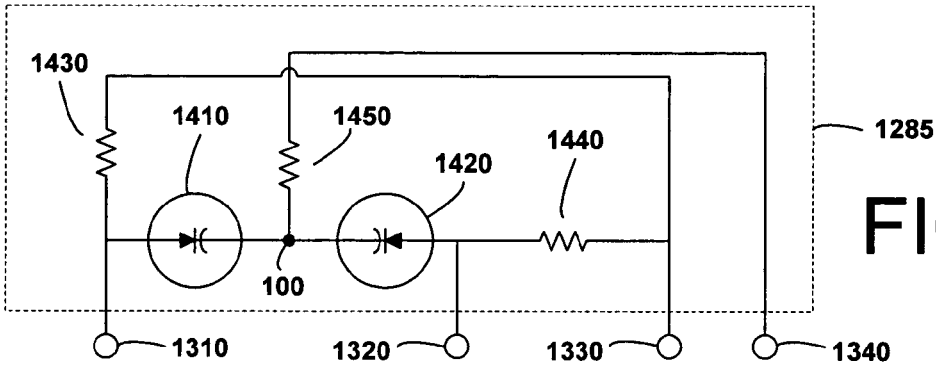
FIG. 14 is a block diagram if the electrical length adjustment circuit of FIG. 13 according to a disclosed embodiment of the present invention.
Figure 15:
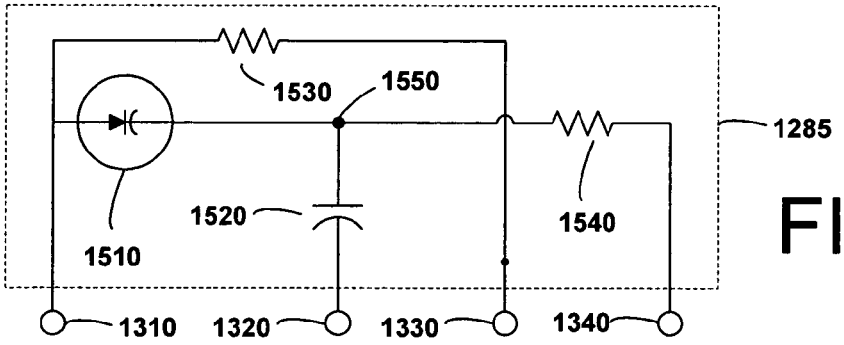
FIG. 15 is a block diagram if the electrical length adjustment circuit of FIG. 13 according to another disclosed embodiment of the present invention.
Figure 16:
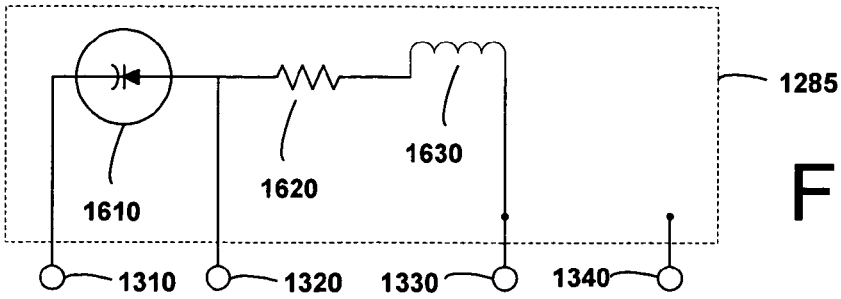
FIG. 16 is a block diagram if the electrical length adjustment circuit of FIG. 13 according to yet another disclosed embodiment of the present invention.

FIGS. 14 through 16 show exemplary embodiments of the electrical length adjustment circuit 1285 of FIG. 12. In particular, FIG. 14 is a block diagram if the electrical length adjustment circuit of FIG. 13 according to a disclosed embodiment of the present invention; FIG. 15 is a block diagram if the electrical length adjustment circuit of FIG. 13 according to another disclosed embodiment of the present invention; and FIG. 16 is a block diagram if the electrical length adjustment circuit of FIG. 13 according to yet another disclosed embodiment of the present invention.

As shown in FIG. 14, the electrical length adjustment circuit 1285 includes a first varactor 1410, a second varactor 1420, a first resistor 1430, a second resistor 1440, and a third resistor 1450. The first varactor 1410 is connected between the first node 1310 and an intermediate node 1460; the second varactor 1420 is connected between the second node 1320 and the intermediate node 1460; the first resistor 1430 is connected between the first node 1310 and the third node 1330; the second resistor is connected between the second node 1320 and the third node 1330; and the third resistor is connected between the intermediate node 1460 and the fourth node 1340. The first resistor 1430 can be eliminated if the input signal from the antenna input 120 has a DC connection to ground.

By changing the control signal provided by the controller 1350 at the fourth node 1340, the electrical length adjustment circuit 1285 can change the electrical length of the conductive line 835, thus changing the notch frequency of the notch in the antenna 1200.

In this embodiment the first and second varactors 1410 and 1420 are connected either back-to-back, or front-to-front. By having two varactors 1410 and 1420 in this embodiment, this electrical length adjustment circuit 1285 can minimize distortion by balancing out the capacitances caused by each varactor 1410 and 1420.

As shown in FIG. 15, the electrical length adjustment circuit 1285 includes a varactor 1510, a capacitor 1520, a first resistor 1530, and a second resistor 1540. The varactor 1510 is connected between the first node 1310 and an intermediate node 1550; the capacitor 1520 is connected between the second node 1320 and the intermediate node 1550; the first resistor 1530 is connected between the first node 1310 and the third node 1330; the second resistor 1540 is connected between the fourth node 1340 and the intermediate node 1550. The first resistor 1530 can be eliminated if the input signal from the antenna input 120 has a DC connection to ground.

In this embodiment the varactor 1510 is isolated from the first driven element 810 by the capacitor 1520, and is driven by a DC back-bias voltage passed by a control signal from the controller 1350 through the second resistor 1540. The resistance of the second resistor 1540 is generally much higher than the input impedance $Z_I$ of the antenna input 120 (e.g., a factor of ten bigger), isolating the varactor 1510 from the controller 1350 for RF frequencies.

By changing the control signal provided by the controller 1350 at the fourth node 1340, the electrical length adjustment circuit 1285 can change the electrical length of the conductive line 835, thus changing the notch frequency of the notch in the antenna 1200.

As shown in FIG. 16, the electrical length adjustment circuit 1285 includes a varactor 1610, a resistor 1620, and an inductor 1630. The varactor 1610 is connected between the first and the second nodes 1310 and 1320; and the resistor 1620 and the inductor 1630 are connected in series between the second and the third nodes 1320 and 1330. The fourth node 1340 can be omitted in this embodiment.

Tuning is accomplished by impressing a static DC back-bias voltage from the antenna input 120 to the first node 1310, through the varactor 1610, through the resistor 1620 and the inductor 1630, and back to ground.

In this embodiment, either the resistor 1620 or the inductor 1630 could be omitted. And the inductance between the second node 1320 and the third node 1330 (caused by whatever of the resistor 1620 and inductor 1630 are provided) is preferably significantly higher (e.g., by a factor of ten) than the input impedance $Z_I$ of the antenna input 120, so as to isolate the varactor 1610 from the controller 1350 for RF frequencies.

In addition to changing the notching frequency, alternate embodiments can also change the notching width by changing the dielectric constant of the various insulating layers 380, 480, 580, and 680. This can be done, for example, by using an insulating material whose dielectric constant can be changed by passing electric current across it. By changing the dielectric constant of the insulating layers 380, 480, 580, and 680, the device changes the characteristic impedance $Z_0$ of the open circuit created by the conductive line 135, 735, 835.

Each of the individual resistors 1430, 1440, 1450.1530, 1540, or resistor-indictor combinations (1620 and 1630) has a high impedance as compared to the input impedance of the antenna input 120, e.g., by a factor of ten, rendering it effectively an open circuit for RF signals, but a short circuit for purposes of controlling the various varactors 1410, 1420, 1510, 1610. For example, if the input impedance $Z_I$ of the antenna input 120 were 50 ohms, the various impedances used for the individual resistors 1430, 1440, 1450. 1530, 1540, or resistor-indictor combinations (1620 and 1630) could be 500 ohms.

In addition, in the embodiment described above with respect to FIG. 2, in which a separate open circuit transmission line is provided (e.g., by a coaxial cable or magnet wire parallel to the second driven element 210), a varactor, switch, or electrical length adjusting circuit could be provided at one or more places along the transmission line.

Other Frequency-Notching Filter

Figure 17:
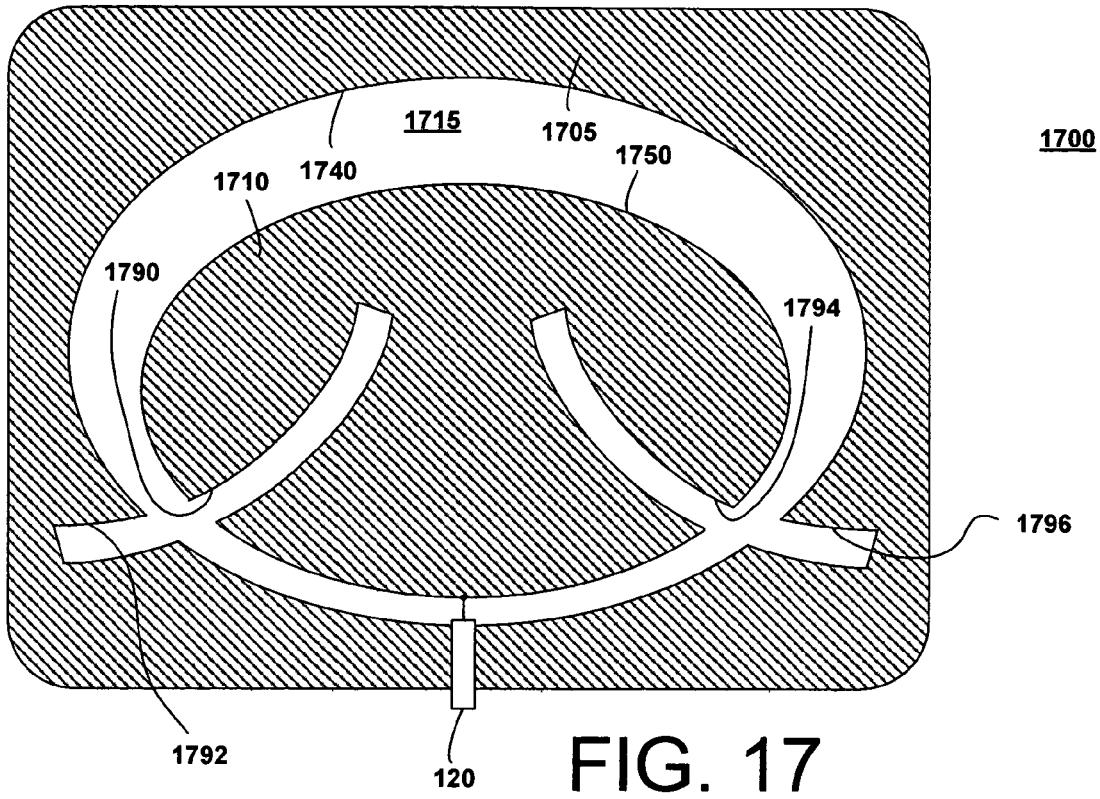
FIG. 17 is an overhead diagram of a first layer of a frequency-notching antenna according to yet another disclosed embodiment of the present invention.
Figure 18:
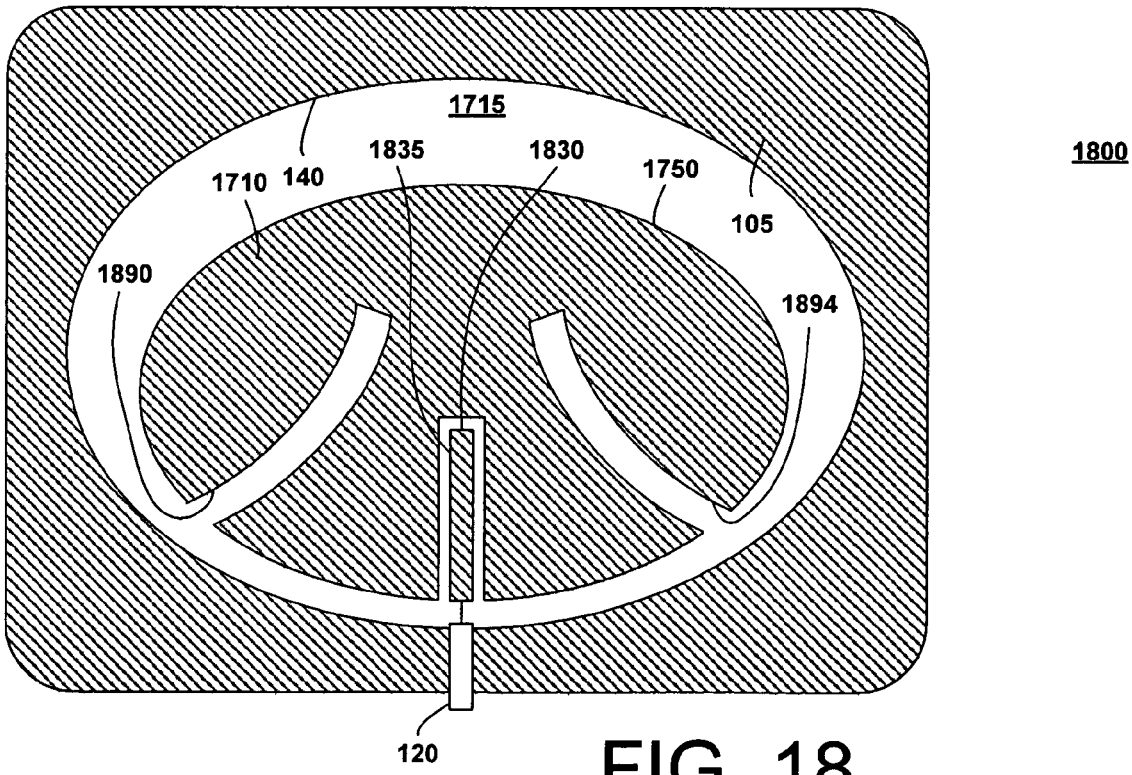
FIG. 18 is an overhead diagram of a first layer of a frequency-notching antenna including multiple notches, according to one disclosed embodiment of the present invention.
Figure 19:
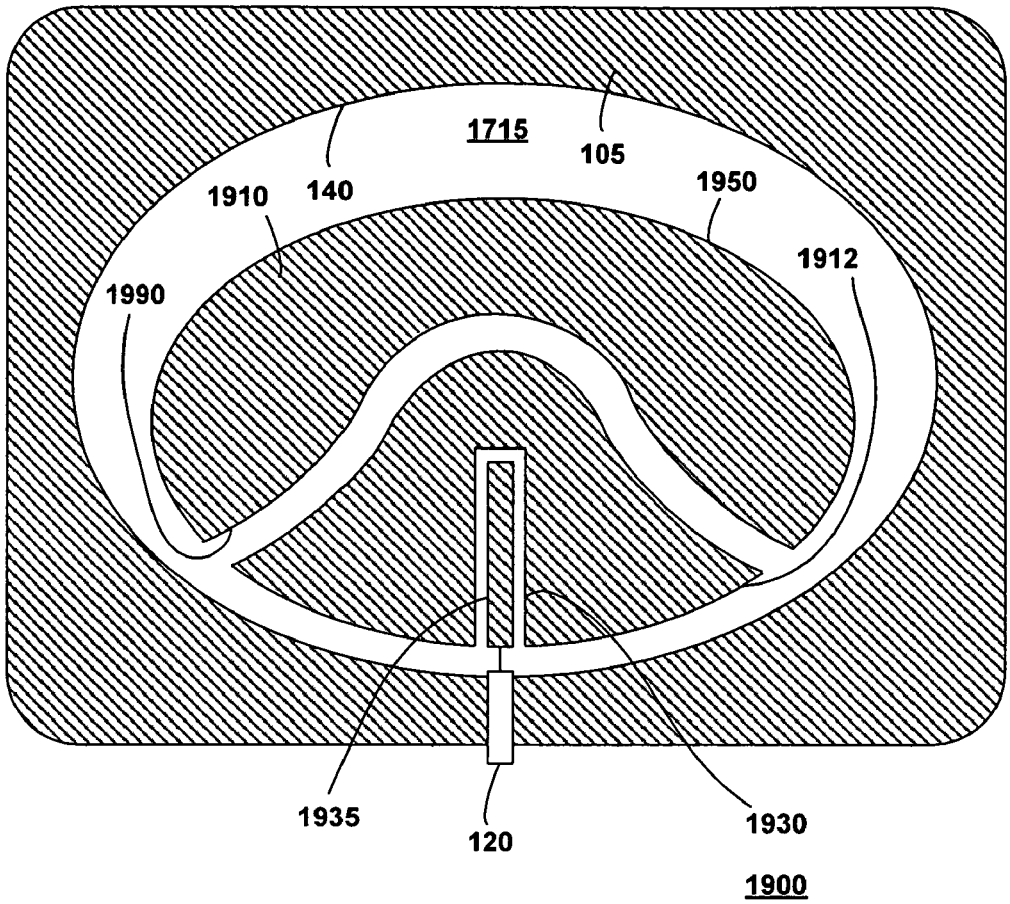
FIG. 19 is an overhead diagram of a first layer of a frequency-notching antenna including multiple notches, according to another disclosed embodiment of the present invention.
Figure 20:
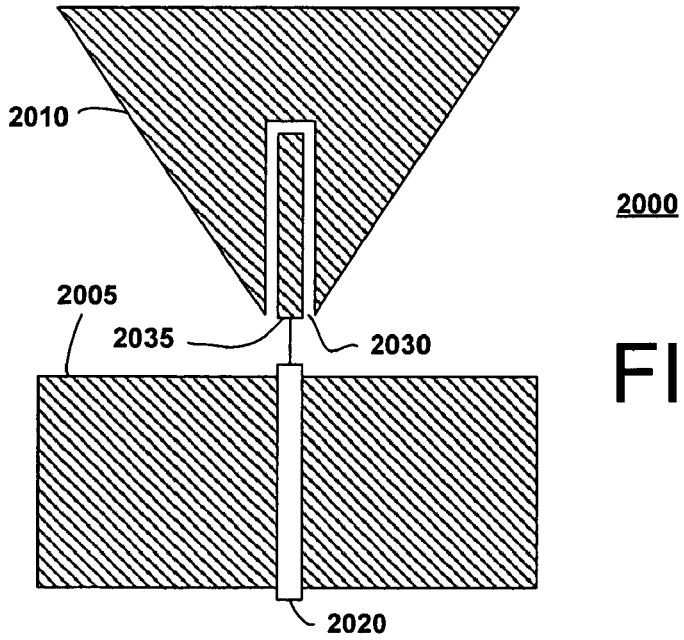
FIG. 20 is a diagram of a frequency-notching antenna, according to yet another disclosed embodiment of the present invention.

In addition to the use of a slot in a driven element and a conductive line in the slot, other embodiments exist to create and tune a notch in an antenna. FIG. 17 is an overhead diagram of a frequency-notching antenna according to yet another disclosed embodiment of the present invention; FIG. 18 is an overhead diagram of a first layer of a frequency-notching antenna including multiple notches, according to one disclosed embodiment of the present invention; FIG. 19 is an overhead diagram of a first layer of a frequency-notching antenna including multiple notches, according to another disclosed embodiment of the present invention; and FIG. 20 is a diagram of a frequency-notching antenna, according to yet another disclosed embodiment of the present invention.

As shown in FIG. 17, the first antenna layer 1700 has a first ground element (i.e., a ground plane) 1705, a first driven element 1710, a first tapered clearance area 1715 between the first ground element 1705 and the first driven element 1710, and an antenna input 120. The first driven element 1710 includes a first slot 1790 and a second slot 1792. The first ground element 1705 includes a third slot 1794 and a fourth slot 1796. Conductive lines can be placed in these slots (e.g., passing through slots 1790 and 1792, or passing through slots 1794 and 1796). In this embodiment the antenna input 120 is directly connected to the first driven element 1710, and drives it by the direct connection.

But, as the driven element has a signal provided to it, and electrical fields pass through the clearance area 1715 they will be pass down the slots 1790, 1792, 1794, and 1796 and be reflected. If the slots 1790, 1792, 1794, and 1796 are a multiple of a quarter of a set wavelength (λ) in electrical length, the energy will be reflected at multiples of 180 degrees causing either a short or open circuit across the slot.

As shown in FIG. 18 the first antenna layer 1800 has a first ground element (i.e., a ground plane) 105, a first driven element 1810, a first tapered clearance area 1815 between the first ground element 105 and the first driven element 1810, a slot 1830 formed in the first driven element 1810, a conductive line 1835 formed in the slot 1830, and an antenna input 120. The first driven element 1810 includes a first slot 1890 and a second slot 1892. The antenna input 120 is connected to the conductive line 1835, and drives the first driven element 1810 through the conductive line 1835 as an open circuit.

This embodiment combines the embodiments of FIGS. 1 and 17. In this embodiment the antenna 1800 includes both a slot 1830 with a conductive line 1835 within it, and open slots 1890 and 1892. The notching provided by these elements is just as described above with respect to FIGS. 1 and 17.

Furthermore, although in FIG. 17 two slots 1790 and 1792 are shown in the first driven element 1710 and two slots 1794 and 1796 are shown in the first ground element 1705, and in FIG. 18 two slots 1890 and 1892 are shown in the first driven element 1810 and no slots are shown in the first ground element 105, these numbers can vary in alternate embodiments. And the first driven element 1710, 1810 and the first ground element 1705, 105 need not have the same number of slots. In addition, although the slots 1790, 1792, 1794, and 1796 in FIG. 17 and 1890 and 1892 in FIG. 18 are shown as being symmetrical around a center line of the antenna 1700, 1800, this is by way of example only. In alternate embodiments the slots may be formed in an asymmetrical pattern. The various slots may also be formed of different physical lengths to change their notching frequencies as well as the polarization of the emitted RF energy.

As shown in FIG. 19 the first antenna layer 1900 has a first ground element (i.e., a ground plane) 105, a first driven element 1910, an open circuit driven portion 1912, a first tapered clearance area 1915 between the first ground element 105 and the first driven element 1910, a slot 1930 formed in the open circuit driven portion 1912, a conductive line 1935 formed in the slot 1930, and an antenna input 120. An open passage 1990 is formed between the first driven element 1910 and the open circuit driven portion 1912. This open passage 1990 is electrically the same as having two open slots that are connected together. The antenna input 120 is connected to the open circuited transmission line formed by the conductive line 1935 and slot 1930 to drive the open circuit driven portion 1912, through the conductive line 1935 as an open circuit.

It is also possible in alternate embodiments to include varactors or switches in any of the slots 1790, 1792, 1794, 1796, 1890, or 1892 in the first driven elements 1710 or 1810, or in the open passage 1990 between the first driven element 1910 and the open circuit driven portion 1912. A varactor can be used as described above with respect to the embodiment of FIG. 11 to change the coupling between the open circuit driven portion 1912 and the first driven element 1910.

Switches can be located at various points along the open slots 1790, 1792, 1794, 1796, 1890, or 1892 or the open passage 1990 to shorten their electrical lengths. In this way the frequency notches caused by the slots unfilled by a conductive line 1835 or 1935 can be made tunable. In the case where an open passage 1990 is used, switches across the open passage 1990 would result in effectively having two slots as in FIG. 18.

Although not shown in FIGS. 17 to 19, the first ground elements 105 or 1705 may also include a plurality of ground element connection vias 160 to be used as first conductive connection elements if the antenna of which the first antenna layer 1700, 1800, or 1900 is a part is a multilevel antenna, to connect the ground element 105 to other ground elements on other levels. Similarly, the first driven element 1710 may include a plurality of driven element connection vias 170 to be used as second conductive connection elements if the antenna of which the first antenna layer 1700, 1800, or 1900 is a part is a multilevel antenna, to connect the first driven element 110 to other driven elements on other levels.

As shown in FIG. 20, the antenna 2000 includes a ground plane 2005, a driven element 2010 with a slot 2030 cut into it, a conductive line 2035 placed in the slot 2030, and an antenna input 120 connected to the conductive line 2030 for driving the driven element 2010 through the conductive line 2035 via an open circuit. This diagram shows a triangular patch antenna or a conical antenna, but this could be a flat circular ovular shape, or a three-dimensional conical shape. Similarly, the ground is shown with square corners, but could be rounded.

The ground plane 2005 is a flat piece of conductive material connected to a ground potential. The driven element 2010 is either a flat triangular piece of conductive metal or a hollow conical piece of conductive material. The driven element 2010 has a slot cut in it, into which the conductive line 2035 is placed. The slot 2030, the conductive line 2035 and the antenna input 120 can be implemented as described above with respect to the antenna input 120, the slots 130, 730, 830, 1790, 1795, 1830, and 1930, and the conductive lines 135, 735, and 835, 1835, and 1935 above. This embodiment can be a multiple-layer antenna in other embodiments in a manner similar to that shown above with respect to the various embodiments above.

In alternate embodiments a varactor and inductive network or an electrical length adjustment circuit 1285 can be included, as shown with respect to FIGS. 11 through 16.

Although the various embodiments above show driven elements as being reniform, oval, and triangular in shape, these are given only by way of example. This invention may be used with antennas of any shape, so long as they can be driven by an open-circuited transmission line.

Conclusion

By providing the antennas described above, the present invention is able to provide notching functions without using up any significant space on a printed circuit board. Any wireless device would have to have an antenna to function. By including notching functions on the antenna, the device is able to make use of existing space more effectively. This could have the effect of reducing the size or complexity of an IC manufactured for a wireless device. This also allows some of the notching of a device to be changed only by changing the antenna, while leaving the IC the same. This can allow for simpler IC designs because multiple notching requirements can be achieved by using different antennas.

This disclosure is intended to explain how to fashion and use various embodiments in accordance with the invention rather than to limit the true, intended, and fair scope and spirit thereof. The foregoing description is not intended to be exhaustive or to limit the invention to the precise form disclosed. Modifications or variations are possible in light of the above teachings. The embodiment(s) was chosen and described to provide the best illustration of the principles of the invention and its practical application, and to enable one of ordinary skill in the art to utilize the invention in various embodiments and with various modifications as are suited to the particular use contemplated. All such modifications and variations are within the scope of the invention as determined by the appended claims, as may be amended during the pendency of this application for patent, and all equivalents thereof, when interpreted in accordance with the breadth to which they are fairly, legally, and equitably entitled. The various circuits described above can be implemented in discrete circuits or integrated circuits, as desired by implementation.

What is claimed is:

1. An antenna, comprising:

a first ground element;

a first driven element formed from a planar piece of conductive material, the first driven element being configured to transmit and receive wireless signals, the first driven element including a physical slot;

a conductive line formed in the physical slot such that the conductive line is separated from the first driven element by a gap filled with non-conductive material, the conductive line having a line impedance that is a function of an effective line width of the conductive line, and an effective gap width of a gap between the conductive line and the first driven element; and a signal line configured to send and receive signals to and from the conductive line.

2. An antenna, as recited in claim 1, wherein the first driven element is one of: triangular in shape, conical in shape, oval in shape, and reniform in shape.

3. An antenna, as recited in claim 1, wherein the ground element has a cutout section with an inner circumference, the inner circumference having a first shape, and wherein the driven element has an outer circumference having a second shape, the driven element being smaller in size than the cutout section and being situated within the cutout section to define a clearance area between the driven element and the ground element.

4. An antenna, as recited in claim 1, further comprising:

a second driven element formed parallel to the first driven element;

a first insulating layer placed between the first and second driven elements.

5. An antenna, as recited in claim 4, further comprising a plurality of first conductive connection elements connecting the first driven element and the second driven element through the first insulating layer.

6. An antenna, as recited in claim 4, further comprising:

a second ground element formed parallel to the first ground element, wherein the first insulating layer is also placed between the first and second ground elements.

7. An antenna, as recited in claim 6, further comprising a plurality of second conductive connection elements connecting the first ground element and the second ground element through the first insulating layer.

8. An antenna, as recited in claim 4, wherein the first insulating layer comprises a dielectric material with a changeable dielectric constant.

9. An antenna, as recited in claim 4, further comprising:

a third ground element formed parallel to the first ground element and on an opposite side of the first ground element as the second ground element;

a third driven element formed parallel to the first driven element and on an opposite side of the first driven element as the second driven element, a second insulating layer placed between the first and third ground elements and between the first and third driven elements.

10. An antenna, as recited in claim 9, further comprising:

a plurality of first conductive connection elements connecting the first ground element and the third ground element through the second insulating layer; and a plurality of first conductive connection elements connecting the first driven element and the third driven element through the second insulating layer.

11. An antenna, as recited in claim 9, wherein the second insulating layer comprises a dielectric material with a changeable dielectric constant.

12. An antenna, as recited in claim 9, wherein the first conductive connection elements connect the first ground element and the second ground element through the first insulating layer, and wherein the second conductive connection elements connect the first driven element and the second driven element through the first insulating layer.

13. An antenna, as recited in claim 1, wherein the physical notch and the conductive line are substantially the same shape.

14. An antenna, as recited in claim 1, wherein the conductive line is one of: rectangular in shape, or curved in shape.

15. An antenna, as recited in claim 1, wherein the antenna is configured to transmit and receive ultrawide bandwidth signals.

16. An antenna, as recited in claim 1, further comprising:

a varactor connected between the conductive line and the first driven element.

17. An antenna, as recited in claim 1, further comprising:

a varactor connected between the conductive line and a first intermediate node;

a connection line connected between the first driven element and the first intermediate node a resistor connected between the first intermediate node and a second intermediate node; and an inductor connected between the second intermediate node and the first ground element.

18. An antenna, as recited in claim 1, further comprising:

an electrical length adjustment circuit connected to the conductive line and the first driven element; and a controller configured to provide a control signal to the electrical length adjustment circuit.

19. An antenna, as recited in claim 18, wherein the electrical length adjustment circuit comprises:

a first varactor connected between the conductive line and an intermediate node;

a second varactor connected between the first driven element and the intermediate node; and a resistor connected between the ground element and the intermediate node, wherein the controller is configured to provide the control signal to the intermediate node.

20. An antenna, as recited in claim 18, wherein the electrical length adjustment circuit comprises:

a varactor connected between the conductive line and an intermediate node;

a capacitor connected between the first driven element and the intermediate node; and a resistor connected between the intermediate node and the controller.

21. An antenna, as recited in claim 1, wherein the non-conductive material comprises a dielectric material with a changeable dielectric constant.

22. An antenna, comprising:

a first ground element;

a first driven element configured to transmit and receive wireless signals;

a second ground element;

a second driven element configured to transmit and receive wireless signals;

an insulating layer placed between the first and second ground elements and between the first and second driven elements;

a conductive line formed in the insulating layer between the first and second driven elements such that the conductive line is separated from the first driven element by a first gap and is separated from the second driven element by a second gap; and a signal line configured to send and receive signals to and from the conductive line.

23. An antenna, as recited in claim 22, further comprising:

a plurality of first conductive connection elements connecting the first ground element and the second ground element through the insulating layer; and a plurality of second conductive connection elements connecting the first, second, and third driven elements through the first insulating layer.

24. An antenna, as recited in claim 22, wherein the first and second driven elements are both one of: triangular in shape, oval in shape, and reniform in shape.

25. An antenna, as recited in claim 22, further comprising:

a varactor connected between the conductive line and one of the first and second driven elements.

26. An antenna, comprising:

a first ground element;

a first driven element formed from a planar piece of conductive material, the first driven element being configured to transmit and receive wireless signals, the first driven element including:

a first physical slot formed at a first location in the first driven element, a second physical slot formed at a second location in the first driven element, and a third physical slot formed at a third location in the first driven element;

a conductive line formed in the first physical slot such that the conductive line is separated from the first driven element by a gap filled with non-conductive material; and a signal line configured to send and receive signals to and from the conductive line, wherein the second and third physical slots are formed in the first driven element to be symmetrical around the first physical slot.

27. An antenna, as recited in claim 26, wherein the first driven element is one of: triangular in shape, conical in shape, oval in shape, and reniform in shape.

28. An antenna, as recited in claim 26, wherein the non-conductive material is a dielectric material with a changeable dielectric constant.

29. An antenna, as recited in claim 26, wherein the antenna is configured to transmit and receive ultrawide bandwidth signals.

30. An antenna, as recited in claim 26, further comprising:

a varactor connected between the conductive line and the first driven element.

* * * * *